US009882321B1

(12) United States Patent
Hibbs et al.

(10) Patent No.: US 9,882,321 B1
(45) Date of Patent: Jan. 30, 2018

(54) COMPACT POWER CONNECTOR

(71) Applicant: Arista Networks, Inc., Santa Clara, CA (US)

(72) Inventors: Richard Hibbs, Santa Clara, CA (US); Robert Wilcox, Santa Clara, CA (US); Youngbae Park, Santa Clara, CA (US); Alex Rose, Santa Clara, CA (US)

(73) Assignee: ARISTA NETWORKS, INC., Santa Clara, CA (US)

( * ) Notice: Subject to any disclaimer, the term of this patent is extended or adjusted under 35 U.S.C. 154(b) by 0 days.

(21) Appl. No.: 15/346,407

(22) Filed: Nov. 8, 2016

(51) Int. Cl.
*H01R 24/60* (2011.01)
*H01R 13/502* (2006.01)
*H01R 107/00* (2006.01)

(52) U.S. Cl.
CPC ..... *H01R 24/60* (2013.01); *H01R 13/502* (2013.01); *H01R 2107/00* (2013.01)

(58) Field of Classification Search
CPC ..... H01R 13/052; H01R 13/20; H01R 13/17; H01R 13/15; H01R 13/18; H01R 25/14; H01R 25/162; H02G 5/007; H02G 5/00
USPC ..... 439/825–827, 251, 213, 115
See application file for complete search history.

(56) References Cited

U.S. PATENT DOCUMENTS 3,622,938 A * 11/1971 Ito ..... H01R 25/145 439/115
3,766,516 A * 10/1973 Appleton ..... H01R 13/15 439/825
3,847,153 A * 11/1974 Weissman ..... A61B 18/14 219/233
4,944,701 A * 7/1990 Spinner ..... H01R 24/40 439/825
7,581,972 B2 * 9/2009 Daamen ..... H01R 13/6315 439/249
8,378,219 B2 * 2/2013 Lesieur ..... H02G 5/007 174/129 B
8,764,495 B2 * 7/2014 Ahangar ..... H01R 13/05 439/825
2009/0130922 A1 * 5/2009 Arnaud ..... H01R 13/629 439/825
2014/0038472 A1 * 2/2014 Ahangar ..... H01R 13/05 439/825

* cited by examiner

*Primary Examiner* — Gary Paumen
(74) *Attorney, Agent, or Firm* — Womble Bond Dickinson

(57) ABSTRACT

A compact connector is provided. The compact connector includes a connector body having a first group of one or more pins on a first face of a contact tip and a second group of one or more pins on an opposed second face of the contact tip. The first group of one or more pins engages with a first busbar, and the second group of one or more pins engages with a second busbar, wherein when the connector engages with the busbars the contact tip is disposed between the first and second busbars. A method of using a connector is also provided.

20 Claims, 4 Drawing Sheets

COMPACT POWER CONNECTOR

BACKGROUND

Busbars provide connections to power and ground for components and printed circuit boards in many electrical and electronic systems. They are especially useful in systems that require high power, high amperage and/or low voltage/power loss. Typically, busbars are coupled to a system by way of a connector, which allows ease of engagement or disengagement to the system, or by way of a screw-tightened permanent connection. There are many off-the-shelf pluggable connectors available. Typically, these pluggable connectors clamp to both sides of a busbar, using a receptacle in the connector with pins on both inner clamping sides of the receptacle for grasping the busbar to create a contact force to establish a stable electrical connection. In the most of these instances, at least two of the pluggable connectors are used to provide supply and return paths for electrical power as well as for ground. As equipment density increases, there is a growing need for a compact pluggable power connector for connecting busbars to electrical systems. Within this context, embodiments of the present invention address this growing need.

SUMMARY

In some embodiments, a compact connector is provided. The compact connector includes a connector body having a first group of one or more pins on a first face of a contact tip and a second group of one or more pins on an opposed second face of the contact tip. The first group of one or more pins engages with a first busbar, and the second group of one or more pins engages with a second busbar, wherein when the connector engages with the busbars the contact tip is disposed between the first and second busbars.

In some embodiments, a compact connector is provided. The connector includes a two pole power connector with a first group of pins on a first face of a contact tip in contact with a first busbar and a second group of pins on an opposed second face of the contact tip in contact with a second busbar, wherein when the connector engages with the first and second busbars, the contact tip is disposed between the first and second busbars.

In some embodiments, a method of using a connector and busbar assembly is provided. The method includes coupling a first busbar to a first group of pins of a first face of a contact tip of a connector, and coupling a second busbar to a second group of pins of a second face of the contact tip of the connector. The method includes constraining the first busbar and the second busbar in spaced apart arrangement with the contact tip between the first busbar and the second busbar.

Other aspects and advantages of the embodiments will become apparent from the following detailed description taken in conjunction with the accompanying drawings which illustrate, by way of example, the principles of the described embodiments.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

A compact connector as described below provides for a reduced connector width and allows for improved airflow through various electrical and electronic systems. The embodiments avoid the need for a receptacle-type, clamping connector, either for mounting to the busbar or mounting to a printed circuit board or component. Since this one single connector, rather than two receptacle-type clamping connectors, couples to two busbars, the envelope or volume requirement is reduced. In addition, airflow through and around the busbars is improved due to the design of the compact connector as illustrated below. The compact connector described herein enables spacing between the busbars to be reduced and the compact connector accommodates busbars of various thicknesses, as the thickness of a busbar is not constrained to meet the width across a clamping-type receptacle of a connector as further described below.

Embodiments of the compact connector may be utilized to provide connections to power and ground to the printed circuit boards of the module cards attached horizontally or vertically to connectors on both sides of the midplane in some networking devices. Currently in these types of devices, the midplane board blocks airflow completely, from one side to the other of the midplane. Replacing a midplane with busbars and using embodiments of the compact connector shown herein allows airflow from one side to the other of the chassis; hence, unblocking or virtually removing obstruction to airflow. In addition, twice as many printed circuit boards to either side of the midplane in current systems are required, as compared to a system without a midplane. While the embodiments described above refer to a midplane configuration, the embodiments are not limited to this type of configuration as the compact connector can be integrated with any suitable system utilizing busbars.

Figure 1:
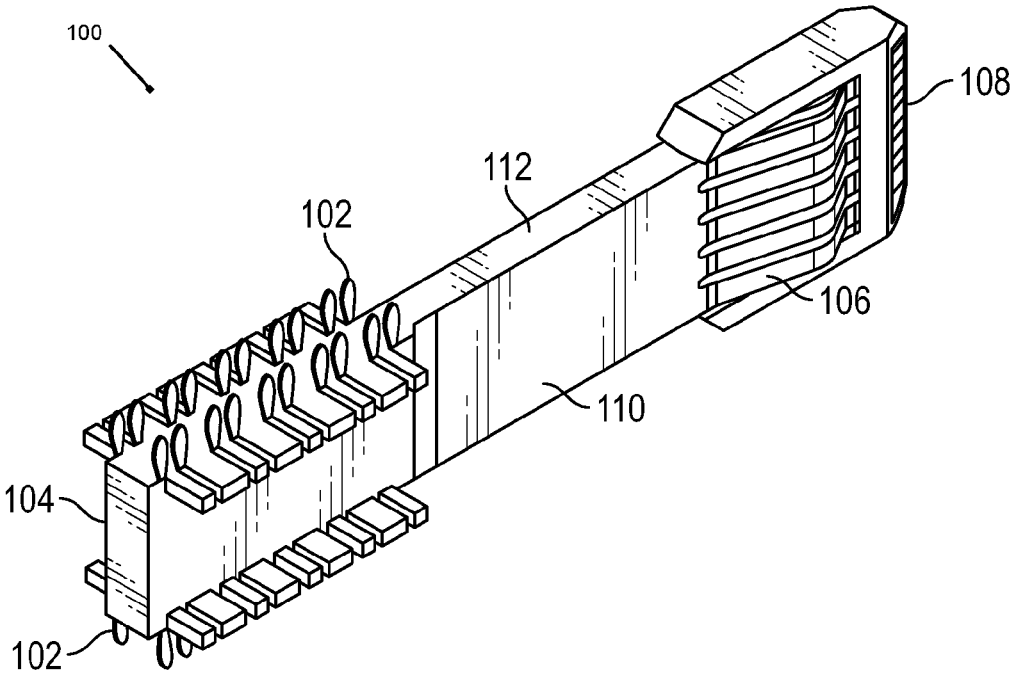
FIG. 1 is a perspective view of a compact connector with pins on opposed sides, for a two-member busbar in accordance with some embodiments.

FIG. 1 is a perspective view of a compact connector 100 with pins 106 on opposed sides, for a two-member busbar in accordance with some embodiments. In the embodiment of FIG. 1, there are two types of pins 102, 106. The pins 102 at the component or printed circuit board-connecting end 104 of the compact connector 100 are dimensioned for insertion into a printed circuit board or component, for example into plated through holes for soldering the pins 102 of the connector to the printed circuit board or component. Pins 102 extend from the body conductor 110 that is mounted to each of two opposed surfaces of a stem 112 of the connector 100, i.e., one body conductor 110 is mounted to the visible surface of the connector in FIG. 1, and another body conductor 110 is mounted to the reverse, non-visible surface of the connector in FIG. 1 (see also the cross-section view in FIG. 2). In this embodiment, the pins 102 for connecting to the printed circuit board or component are extending from opposed edges of the stem 112 of the connector 100, and are parallel to a majority of the body conductors 110. However, the pins 102 for connecting to the printed circuit board or component could be in other orientations in numbers or in other configurations or types in various further embodiments. It should be appreciated that stem 112 may be composed of any non-conductive or insulative material.

Still referring to FIG. 1, the pins 106 at the busbar-connecting end 108 of the connector 100 are dimensioned and arranged for connecting or coupling to a respective busbar, as further explained below with reference to FIGS. 2-7. In the embodiment shown in FIG. 1, these pins 106 may be cantilevered or extended from a surface of the connector 100, more specifically as fingers extending at a nonzero angle from the body conductor 110, in a cantilever arrangement or the like. Various manufacturing techniques are readily devised, such as stamping and forming the body conductor 110 and pins 106 from a sheet of copper or other conducting material, and attaching one of the resultant pieces to one side of the stem 112 and another of the resultant pieces to the opposed side of the stem 112.

Figure 2:
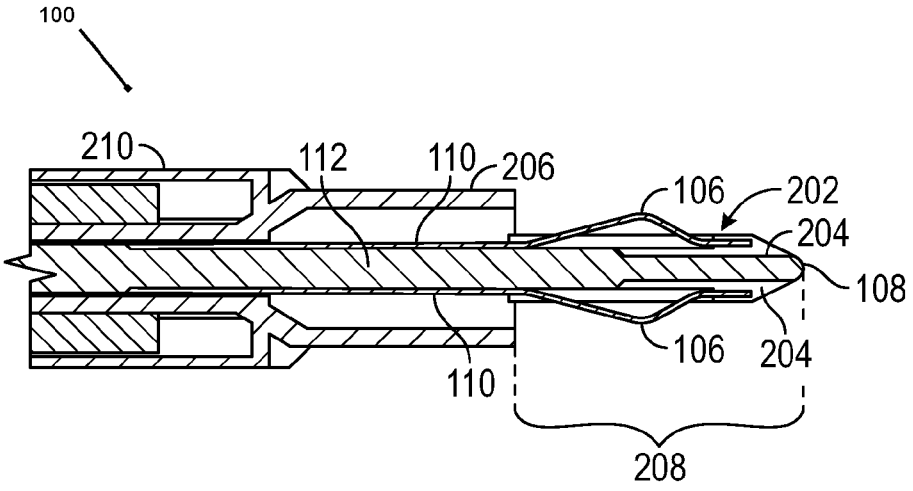
FIG. 2 is a cross-section view of a further embodiment of the connector of FIG. 1, with details about a contact tip and a portion of a sleeve with a cover in accordance with some embodiments.

FIG. 2 is a cross-section of a top view of a further embodiment of the connector 100 of FIG. 1, with details about a contact tip 208 and a portion of a sleeve 210 with a retractable cover 206. The sleeve 210 may be made of any suitable non-conductive material, for example injection molded plastic, in some embodiments, although other materials may be utilized for the sleeve. The sleeve 210 with integral cover 206 is slidable along the stem 112 to cover or uncover the contact tip 208 of the connector. Visible in FIG. 2 are the body conductors 110 on opposed faces or surfaces of the stem 112, and also the pins 106 as fingers extending from the body conductors 110, on opposed faces or surfaces of the stem 112. Conductor tips 202 of the pins 106 are inserted into pockets 204 at the busbar-connecting end 108 of the connector 100, for example cavities in one end of the stem 112 in some embodiments. Pocket 204 may be a cavity defined within an opening between the outer surface of the contact tip 208 and a surface of stem 112, i.e., a face of the portion of the stem proximate to an end of the contact tip. In some embodiments, an opening defined between the outer surface of the contact tip 208 and a surface of stem 112 is sufficient to accommodate the width of pin 106. It should be appreciated that this configuration protects the conductor tips from bending during handling of the connector 100 and provides some resistance to the flexing of pins 106 when a pressure is exerted inward such as when the contact tip is inserted between busbars.

In some embodiments, the body connector 110 and associated pins 106 on one face of the stem 112 are all associated with electrical ground conductivity, and the body connector 110 and associated pins 106 on the opposed face of the stem 112 are all associated with power conductivity. In further embodiments, one face of the stem 112 has a body connector 110 and pins 106 associated with electrical ground conductivity and also a body connector 110 and pins 106 associated with power conductivity. The opposed face of the stem 112 has a further body connector 110 and pins 106 associated with electrical ground conductivity, and a further body connector 110 and pins 106 associated with power conductivity. Further variations are readily devised. Also, in some embodiments, pins 106 associated with electrical ground conductivity are dimensioned (e.g., longer or extending farther) to make contact with a busbar associated with electrical ground conductivity prior to further pins 106 associated with power conductivity making contact with a busbar associated with power conductivity, upon insertion of the contact tip 208 between two busbars. In this arrangement, a ground connection is made before any power connection.

Figure 3:
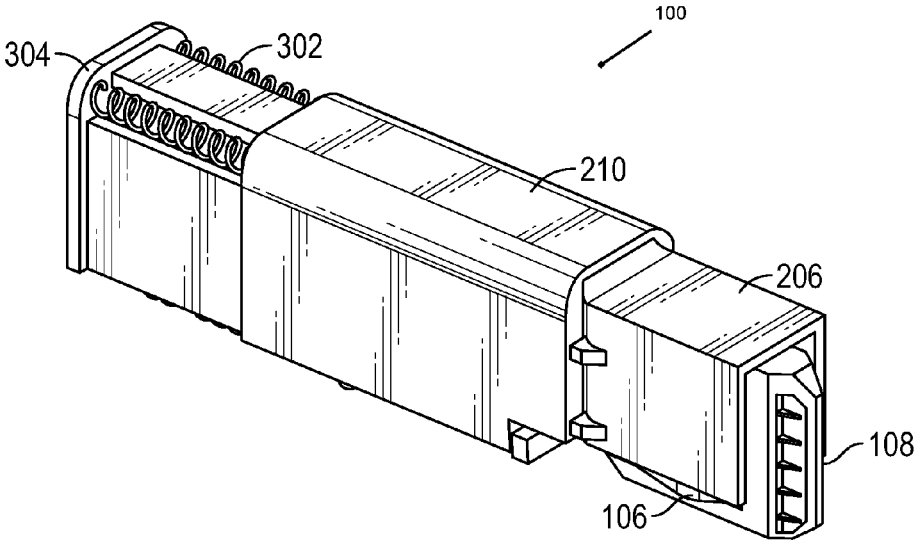
FIG. 3 is a perspective view of the connector of FIG. 2, with the spring-loaded cover on or covering the contact tip in accordance with some embodiments.

FIG. 3 is a perspective view of the connector 100 of FIG. 2, with the spring-loaded cover 206 on or covering the contact tip 208. One or more springs 302 are installed to or into the connector 100, to provide a restoring force to the sleeve 210 in the direction of protecting the contact tip 208. For example, as shown in FIG. 3, there are two springs 302, or more springs 302 in further embodiments, inserted into respective cavities in the sleeve 210 and pressing against a spring base 304 of the connector 100. In this depiction, the sleeve 210 is in a forward position, towards the busbar-connecting end 108 of the connector 100, with the one or more springs 302 extended, and the cover 206 in a contact-protecting position.

Figure 4:
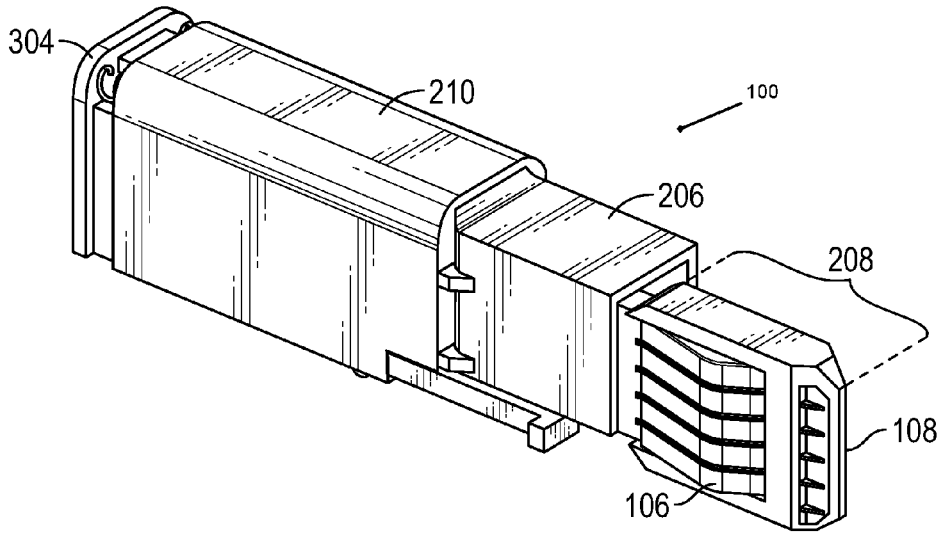
FIG. 4 is a perspective view of the connector of FIGS. 2 and 3, with the spring-loaded cover pushed back, exposing the contact tip in accordance with some embodiments.

FIG. 4 is a perspective view of the connector of FIGS. 2 and 3, with the spring-loaded cover 206 pushed back, exposing the contact tip 208. The spring(s) 302 are compressed, and the sleeve 210 is slid backward, towards the spring base 304 of the connector, so that the cover 206 is in a contact-exposing position. The sleeve 210 can be operated manually in some embodiments, for example by an installer grasping the sleeve 210 and pushing or pulling the sleeve 210 to slide the sleeve 210 relative to the internal members of the connector 100 and the contact tip 208. In some embodiments, the action of inserting the contact tip 208 between two busbars (see FIGS. 5 and 6), or equivalently, assembling the busbars to the connector, could have the busbars pressing the cover 206 and sleeve 210 back towards the spring base 304, exposing the contact tip 208.

Figure 5:
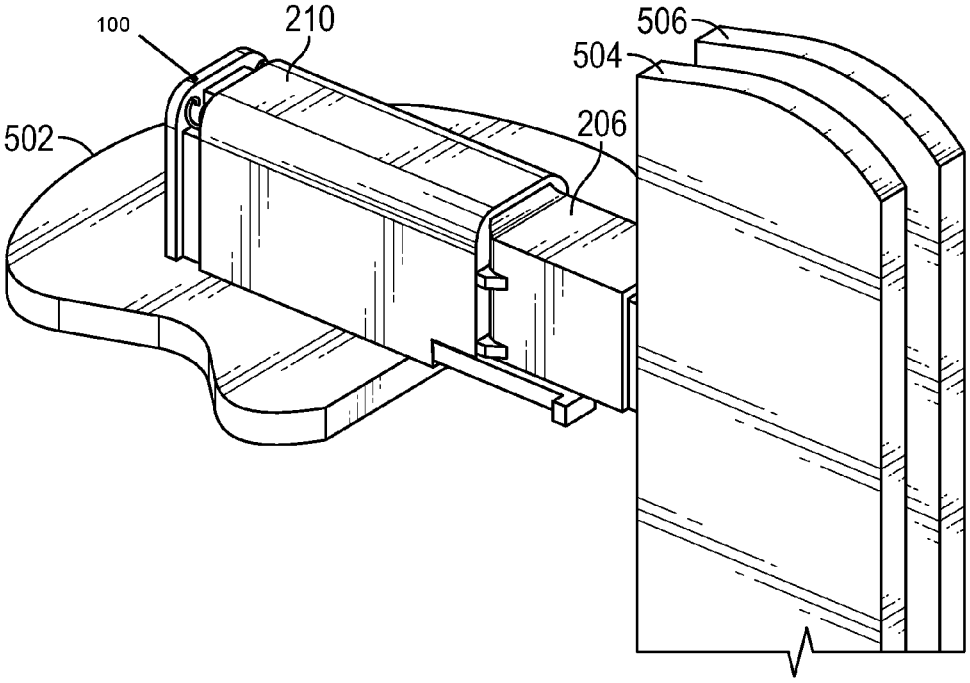
FIG. 5 is a perspective view of the connector of FIGS. 2-4 assembled to a printed circuit board and the two-member busbar in accordance with some embodiments.

FIG. 5 is a perspective view of the connector of FIGS. 2-4 assembled to a printed circuit board (PCB) 502 and the two-member busbar 504, 506. The connector 100 is mounted to the printed circuit board 502, for example by soldering pins 102 of the connector 100 to the printed circuit board 502. In this embodiment, the connector 100 has pins 102, for connecting to a printed circuit board or component, only on one edge of the connector. To accommodate and not interfere with the pins 102, the sleeve 210 has a cutout or no face on one part of the connector 100. With the sleeve 210 of the connector 100 slid backward and the cover 206 in the contact-exposing position depicted in FIG. 4, the contact tip 208 of the connector is inserted, placed, or located between the first busbar 504 and the second busbar 506 of the two-member busbar 504, 506. In other words, an inner surface of the first busbar 504 and an inner surface of the second busbar 506 sandwich the contact tip 208 of the connector, or the contact tip 208 is sandwiched between the first busbar 504 and the second busbar 506. It should be appreciated that no part of the contact tip 208 grasps, contacts or is on an outward-facing surface of the first and second busbars 504, 506. That is, the contact tip 208 does not sandwich or surround the first busbar 504 and does not sandwich or surround the second busbar 506, as would a receptacle-type contact that receives a busbar into a receptacle that has contacts to both faces of the busbar.

Figure 6:
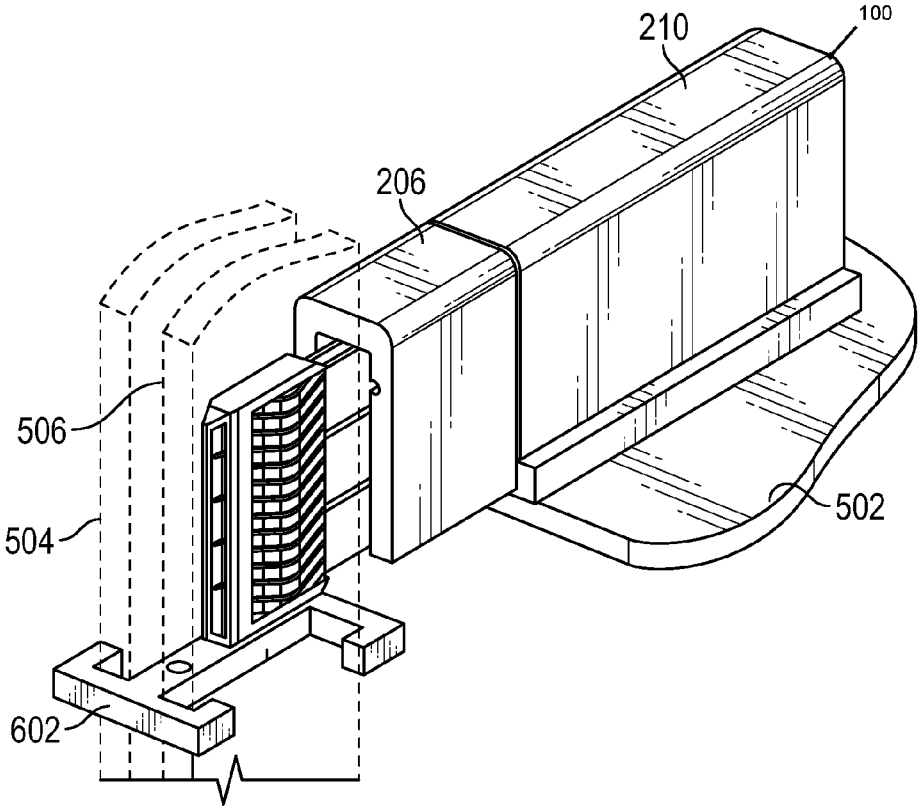
FIG. 6 is a perspective view of the connector and two-member busbar, which is similar to that of FIG. 5, but without a retractable cover. The assembly shows a spacing clip restraining the two members of the busbar in contact with the contact tip of the connector in accordance with some embodiments.

FIG. 6 is a perspective view of the connector 100 and two-member busbar 504, 506 of FIG. 5, with a spacing clip 602 restraining the two members of the busbar 504, 506 in contact with the contact tip 208 of the connector. The two busbars 504, 506 are shown as being transparent, so that the contact tip 208 between the busbars 504, 506 is visible in the diagram. In this embodiment, spacing between the busbars 504, 506 is about 4 mm, or less than or equal to about 5 mm, although the connector 100 may accommodate any busbar spacing. The spacing clip 602 holds and constrains the two busbars 504, 506 in a substantially parallel, spaced apart arrangement, with a surface of each busbar 504, 506 pressing on or engaged with respective pins 106 of the contact tip 208 of the connector 100. That is, the spacing clip 602 constrains the two busbars 504, 506 with all pins 106 of the contact tip 208 of the connector 100 in physical contact with inward facing surfaces of the first and second busbars 504, 506. Since the busbars 504, 506 are not clamped by the connector, the busbars 504, 506 are free to float with respect to the connector 100 and are not rigidly attached to the connector 100, e.g., by fasteners. In some embodiments, the busbars 504, 506 are mounted to a chassis, within which the printed circuit board 502 and connector 100 are also mounted, so that the busbars 504, 506 float relative to the connector. Suitable mounting techniques and components, such as brackets and fasteners or adhesive, are readily devised in keeping with the teachings herein. In the embodiment shown in FIG. 6, the spacing clip 602 resembles the letter "H", but other shapes for a spacing clip are readily devised, such as a clip resembling the letter "E" or an elastic clip resembling the number "8", etc. The thickness of the crossbar of the "H" determines the spacing between the busbars 504, 506, with one busbar 504 constrained in the upper portion of the "H", and the other busbar 506 constrained in the lower portion of the "H". Since, in this embodiment, the entirety of the contact tip 208 of the connector 100 is between the two busbars 504, 506 (e.g., between the opposing inward surfaces of the busbars 504, 506), and no part of the contact tip 208 is on the outward surfaces of the busbars 504, 506 as would be the case with two receptacle-type connectors attached to the printed circuit board 502, airflow over the components is less restricted, resulting in more efficient cooling. The embodiment of FIG. 6 illustrates the connector 100 without a retractable cover. As noted above, the connector is agnostic to the thickness of a busbar as the connector is not constrained to meet the width across a clamping-type receptacle of a connector.

Figure 7:
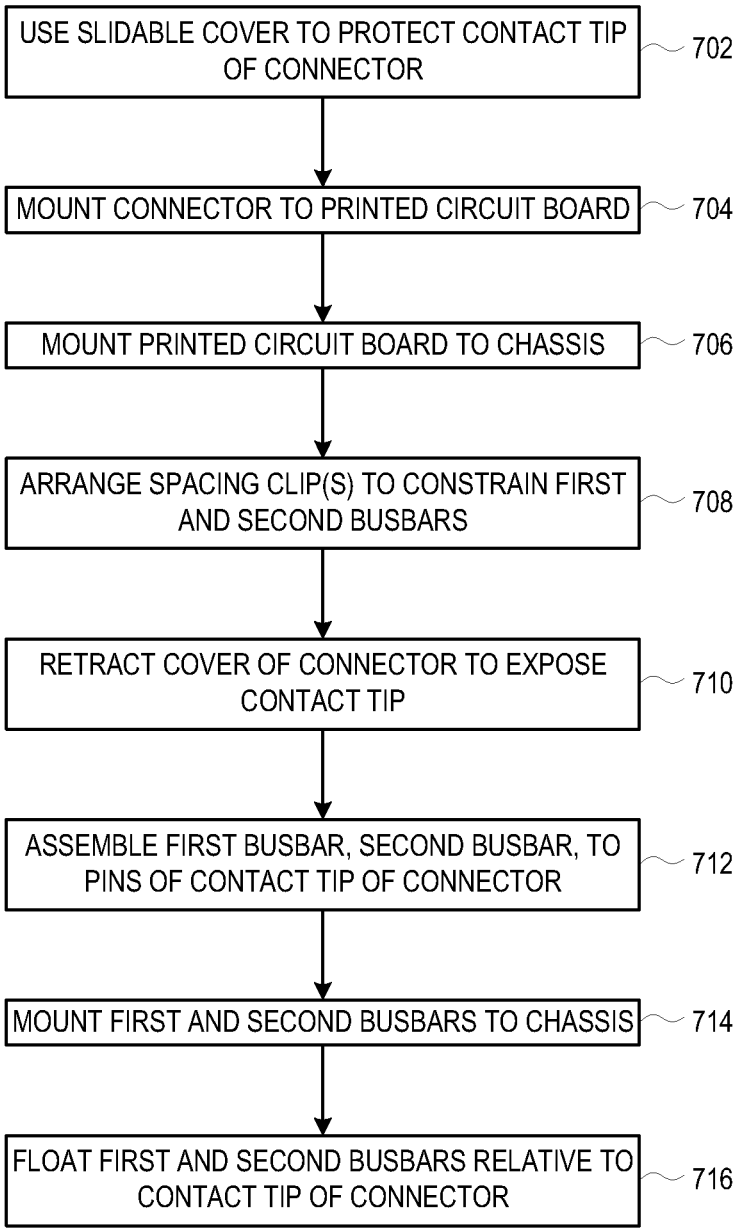
FIG. 7 is a flow diagram of a method of making and employing a compact connector, which can be practiced using embodiments of the connector described herein.

FIG. 7 is a flow diagram of a method of making using a compact connector, which can be practiced using embodiments of the connector and two-member busbar described herein. The method can be practiced by a person or machine (e.g., in automated or robotic manufacturing) assembling an embodiment of the connector and busbar assembly. A related method, of using the connector and busbar assembly, for example in a chassis, is also described below. A slidable cover is used to protect the contact tip of the connector, in an action 702. A cross-section view of the sleeve, with cover, is shown in FIG. 2, and the cover and sleeve are shown in solid view in FIGS. 3-5. The cover protects the pins (e.g., fingers extending from the body conductors) at the busbar-connecting end of the connector. The connector is mounted to a printed circuit board (or component), in an action 704. For example, pins at the component or printed circuit board-connecting end of the connector are soldered to the printed circuit board or component. The printed circuit board (or component) to which the connector is mounted is coupled to a chassis, in an action 706. Brackets, fasteners and/or adhesives could be used for mounting. One or more spacing clips are arranged to constrain the first and second busbars, in an action 708. One example of a spacing clip is shown in FIG. 6, and other spacing clips are readily devised. A spacing clip could be slid along the busbars, or busbars inserted into the spacing clip, for example.

Still referring to FIG. 7, the cover of the connector is retracted, to expose the contact tip, in an action 710. One example of a cover for the connector is showed in FIGS. 3-6. That cover is integral with a slidable sleeve, and is spring-loaded in some embodiments. The first busbar and the second busbar are assembled to or engaged with pins of the contact tip of the connector, in an action 712. Two ways of doing so are to press the two busbars onto the contact tip, or to insert the contact tip between the two busbars. The first and second busbars are mounted to the chassis, in an action 714. Brackets, fasteners and/or adhesives could be used for mounting. In variations, the busbars could be mounted to the chassis before, after or at the same time the printed circuit board (or component) is mounted to the chassis in the action 706. The first and second busbars are floated relative to the contact tip of the connector, in an action 716. That is, the first and second busbars are not rigidly attached or affixed to the contact tip of the connector, e.g., by a receptacle, clamp, fasteners, adhesive, etc., but instead are allowed to float so that the busbar and connector assembly is resistant to physical shock.

In using the connector and busbar assembly, the first busbar is coupled to or engaged with the first group of pins of the first face of the contact tip of the connector, for example by the chassis or other mounting system. The second busbar is coupled to or engaged with the second group of pins of the second face of the contact tip of the connector, again by the chassis or other mounting system. Suitable arrangements of the first and second busbars, the contact tip, the connector, and a portion of a printed circuit board that could be mounted in the chassis are shown in FIGS. 5 and 6. The first busbar and second busbar are constrained in a spaced apart arrangement with the contact tip between the first busbar and the second busbar, again by the chassis or other mounting system. The constraining is with the cover of the connector retracted to expose the contact tip, as shown in FIGS. 4-6. In some embodiments, a spacing clip as shown in FIG. 6 is used for constraining the first and second busbars. Brackets or other mounting hardware as readily devised could also be used to constrain the first and second busbars.

Detailed illustrative embodiments are disclosed herein. However, specific functional details disclosed herein are merely representative for purposes of describing embodiments. Embodiments may, however, be embodied in many alternate forms and should not be construed as limited to only the embodiments set forth herein. It should be appreciated that descriptions of direction and orientation are for convenience of interpretation, and the apparatus is not limited as to orientation with respect to gravity. In other words, the apparatus could be mounted upside down, right side up, diagonally, vertically, horizontally, etc., and the descriptions of direction and orientation are relative to portions of the apparatus itself, and not absolute.

It should be understood that although the terms first, second, etc. may be used herein to describe various steps or calculations, these steps or calculations should not be limited by these terms. These terms are only used to distinguish one step or calculation from another. For example, a first calculation could be termed a second calculation, and, similarly, a second step could be termed a first step, without departing from the scope of this disclosure. As used herein, the term "and/or" and the "/" symbol includes any and all combinations of one or more of the associated listed items.

As used herein, the singular forms "a", "an" and "the" are intended to include the plural forms as well, unless the context clearly indicates otherwise. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof. Therefore, the terminology used herein is for the purpose of describing particular embodiments only and is not intended to be limiting.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Although the method operations were described in a specific order, it should be understood that other operations may be performed in between described operations, described operations may be adjusted so that they occur at slightly different times or the described operations may be distributed in a system which allows the occurrence of the processing operations at various intervals associated with the processing.

Various units, circuits, or other components may be described or claimed as "configured to" perform a task or tasks. In such contexts, the phrase "configured to" is used to connote structure by indicating that the units/circuits/components include structure (e.g., circuitry or mechanical features) that performs the task or tasks during operation. As such, the unit/circuit/component can be said to be configured to perform the task even when the specified unit/circuit/component is not currently operational (e.g., is not on). The units/circuits/components used with the "configured to" language include hardware—for example, circuits, memory storing program instructions executable to implement the operation, etc. Reciting that a unit/circuit/component is "configured to" perform one or more tasks is expressly intended not to invoke 35 U.S.C. 112, sixth paragraph, for that unit/circuit/component. Additionally, "configured to" can include generic structure (e.g., generic circuitry) that is manipulated by software and/or firmware (e.g., an FPGA or a general-purpose processor executing software) to operate in manner that is capable of performing the task(s) at issue. "Configured to" may also include adapting a manufacturing process (e.g., a semiconductor fabrication facility) to fabricate devices (e.g., integrated circuits or manufactured articles) that are adapted to implement or perform one or more tasks, or designing an article or apparatus to have certain features or capabilities.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the embodiments and its practical applications, to thereby enable others skilled in the art to best utilize the embodiments and various modifications as may be suited to the particular use contemplated. Accordingly, the present embodiments are to be considered as illustrative and not restrictive, and the invention is not to be limited to the details given herein, but may be modified within the scope and equivalents of the appended claims.

What is claimed is:

1. A compact connector for engaging busbars, comprising:

a first busbar and a second busbar, configurable to have differing voltages or power and ground connections from each other;

a connector body having a first group of one or more pins on a first face of a contact tip and a second group of one or more pins on an opposed second face of the contact tip;

the first group of one or more pins engaging the first busbar; and the second group of one or more pins engaging the second busbar, wherein when the connector engages with the first and second busbars, the contact tip is disposed between the first and second busbars.

2. The connector of claim 1, further comprising:

a pocket defined towards an end of the contact tip, the pocket disposed between an outer surface of the contact tip and one of the first face of the second face.

3. The connector of claim 1, wherein the first busbar and the second busbar are coupled to a chassis and wherein the first and second busbars float relative to the connector.

4. The connector of claim 1, further comprising:

a cover having a first position covering the contact tip and a second position exposing the contact tip.

5. The connector of claim 1, further comprising:

each pin of the first group and the second group attached to the connector in a cantilever arrangement.

6. The connector of claim 1, wherein:

neither the first busbar nor the second busbar has a receptacle to connect to the connector; and the connector does not have a receptacle to grasp a busbar.

7. The connector of claim 1, wherein the connector is configured to accommodate first and second busbars of various thicknesses.

8. A compact connector, comprising:

a two pole power connector with a first group of pins on a first face of a contact tip engaging with a first busbar and a second group of pins on an opposed second face of the contact tip engaging with a second busbar, wherein when the connector engages with the first and second busbars, the contact tip is disposed between the first and second busbars.

9. The connector of claim 8, further comprising:

a spacing clip holding the first busbar and the second busbar in parallel, spaced apart arrangement with the first busbar pressing on the first group of pins and the second busbar pressing on the second group of pins.

10. The connector of claim 8, further comprising:

a chassis, with the first busbar and the second busbar attached to the chassis and floating with respect to the two pole power connector.

11. The connector of claim 8, further comprising:

a spring-loaded cover attached to the connector and having a first position that covers the contact tip and a second position that exposes the contact tip.

12. The connector of claim 8, further comprising:

the first group of pins and the second group of pins cantilevered from the connector, with conductor tips in one or more pockets of the contact tip.

13. The connector of claim 8, wherein the first busbar and the second busbar have no receptacle connecting to the first and second group of pins.

14. The connector of claim 8, wherein the connector is agnostic to thickness of the first busbar and the second busbar.

15. A method of using a connector, comprising:

coupling a first busbar to a first group of pins of a first face of a contact tip of a connector;

coupling a second busbar to a second group of pins of a second face of the contact tip of the connector; and constraining the first busbar and the second busbar in a spaced apart arrangement with the contact tip between the first busbar and the second busbar.

16. The method of claim 15, wherein the constraining comprises:

having a spacing clip on the first and second busbars.

17. The method of claim 15, wherein the constraining is with a cover of the connector retracted to expose the contact tip.

18. The method of claim 15, wherein the coupling the first and second busbars to the contact tip of the connector and the constraining the first and second busbars comprises:

floating the first and second busbars relative to the connector, with the first and second busbars coupled to a chassis.

19. The method of claim 15, wherein the constraining is without using a receptacle to connect the first and second busbars to the first and second groups of pins.

20. The method of claim 15, wherein the constraining is with all pins of the contact tip in physical contact with inward facing surfaces of the first and second busbars.

* * * * *